United States Patent [19]

Kastinger

[11] 3,972,134

[45] Aug. 3, 1976

[54] SKIING BOOT

[76] Inventor: Hermann Kastinger, Hauptstrasse 27, Seewalchen, Austria

[22] Filed: May 27, 1975

[21] Appl. No.: 580,888

[30] Foreign Application Priority Data

May 5, 1975 Austria ..... 3431/75

[52] U.S. Cl. ..... 36/118

[51] Int. Cl.[2] ..... A43B 00/00

[58] Field of Search ..... 36/2.5 R, 2.5 AL, 45, 36/50

[56] References Cited

UNITED STATES PATENTS

| | | | |
|---|---|---|---|
| 3,535,800 | 10/1970 | Stohr | 36/2.5 AL |
| 3,807,060 | 4/1974 | Hanson et al. | 36/2.5 AL |
| 3,807,062 | 4/1974 | Spier | 36/2.5 AL |

*Primary Examiner*—Patrick D. Lawson
*Attorney, Agent, or Firm*—Kurt Kelman

[57] ABSTRACT

The skiing boot comprises an upper of plastics material and a sole integrally molded with said upper. The boot has an instep bend, a substantially stiff rear portion extending from said instep bend to the rear end of the boot, and a forward portion extending from said instep bend to the forward end of the boot. The forward portion is formed with areas of reduced wall thickness, which areas extend transversely to the longitudinal direction of the boot are disposed in at least one zone which is spaced behind the forward end of the boot and extends transversely to the longitudinal direction of the boot so that said forward portion is adapted to be bent about said zone.

8 Claims, 2 Drawing Figures

Figures 1, 2:
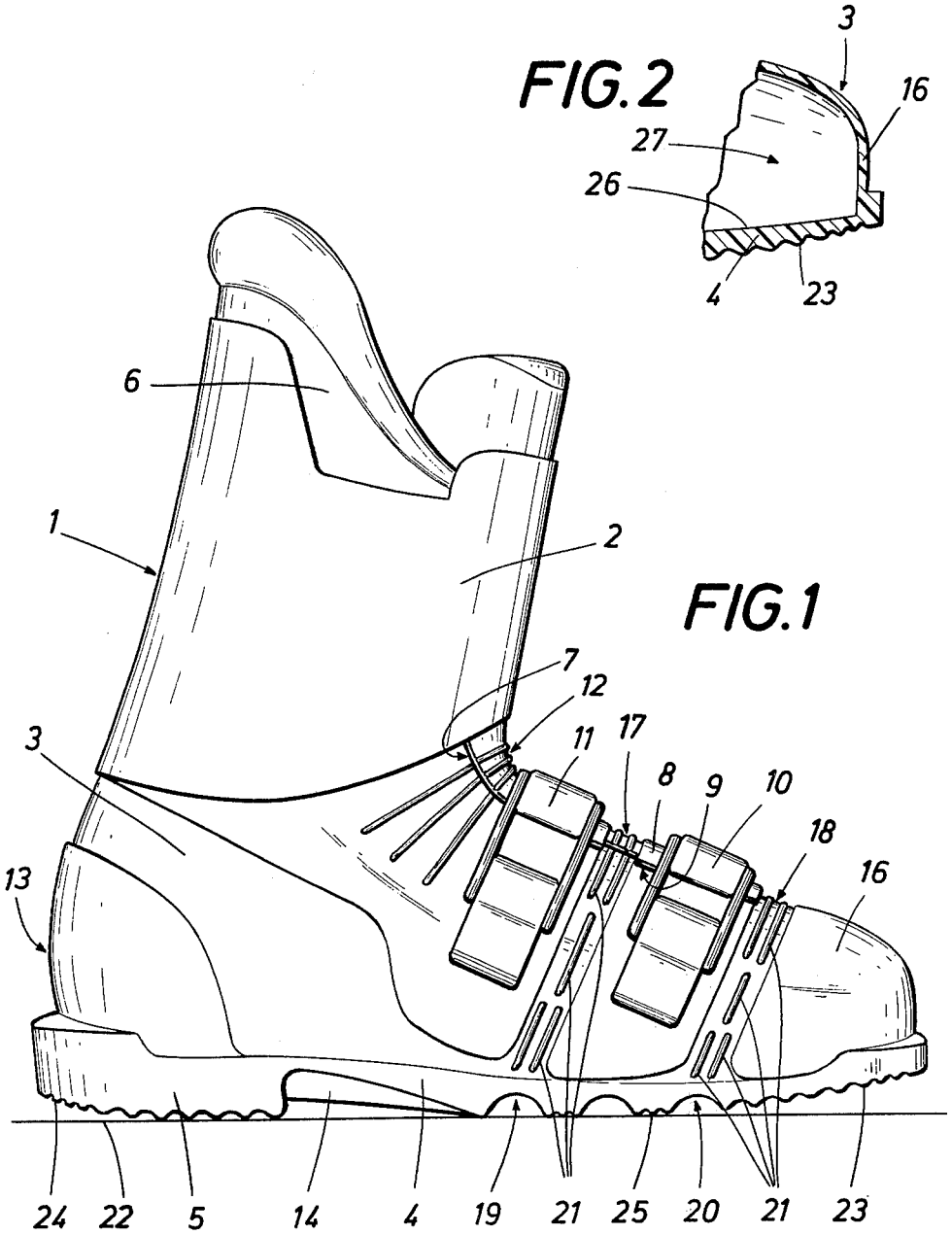

3
16
27
26
4
23

6
1
2
7
12
11
17
8
9
10
18
16
3
13
24
22
5
14
4
19
21
25
20
21
23

SKIING BOOT

This invention relates to a skiing boot comprising an upper made of synthetic resin or plastics material and a sole integrally formed with the upper.

Most skiing boots of this kind are provided with an inner boot which is adaptable to the shape of the foot. Skiing boots made of synthetic resin or plastics material have the advantage that they require virtually no maintenance and are moisture-tight and that the skiing boot can be used to establish a highly exact connection between the foot and lower leg, when this is required. These known skiing boots having a stiff upper for good control of the ski but cannot be worn conveniently without a ski because they are so stiff that walking is difficult.

The known skiing boots of the present kind are provided with a continuous stiff sole, which in many cases consists of a rectangular sole which is only as wide as or narrower than the ski. Most of the conventional safety ski bindings require a continuous stiff sole. It has been attempted to facilitate walking in some degree by curving the tread face of the sole upwardly of the forward end of the boot but walking cannot be decisively facilitated by such measure.

A skiing boot of the kind defined first hereinbefore is improved according to the invention in that the sole an/or the upper are provided in their forward portion with transversely extending areas of reduced wall thickness, which areas are preferably arranged in one annular zone or in a plurality of spaced apart annular zones so that the forward portion of the skiing boot can be bent about an axis which is transverse to the axis of the sole whereas the skiing boot is substantially stiff between the instep bend and the rear end of the boot.

The invention is based on the recognition that an upper which is stiff only in its length portion disposed between the instep bend and the rear end of the boot can transmit the essential controlling forces from the foot or lower leg to the ski and that virtually no essential steering forces are transmitted by the forward portion of the boot. It has also been found that in modern safety ski bindings, particularly in the so-called plate-type safety ski bindings, which comprise a footplate that is adjustable relative to the gripping jaws or the like, a boot can be satisfactorily held even if it does not have a continuous stiff sole. The design according to the invention enables a bending of the forward portion of the skiing boot about one or more flexible transverse zones which are provided, so that walking with such skiing boot is much facilitated. The neutral axis about which the boot can be bent can be selected as desired by the selection of the shape and depth of the area of reduced wall thickness. This area of reduced wall thickness can be shaped so that the neutral axis extends through the sole or, in another case, through the cavity of the upper at desired points.

The provision of areas of reduced wall thickness may be combined with other features which facilitate walking, e.g., the use of a sole which is curved from its ball portion to its forward end. Clearly defined bend lines are provided, whereas the important advantages of an upper of synthetic resin or plastics material, particularly a high strength, absence of a need for maintenance, and easy manufacture by injection molding or casting, are preserved. The flexibility can be increased by tapering the sole in thickness between its ball portion and its forward end, e.g., in the shape of a wedge.

The invention may be applied to all skiing boots of the kind mentioned first hereinbefore. If the boots of this kind are to be classified in dependence on the type of the closing means, the invention may be applied to skiing boots having a slotted upper and a tongue, and to skiing boots having a closure flap on the front or rear side and an upper which remains closed adjacent to the instep.

Where the invention is applied to skiing boots in which the upper has an opening that is covered by a tongue or the upper has a slot defined by overlapping edges, the flexible zones in which the wall thickness is reduced will be provided between adjacent buckles and between adjacent keepers. The flexible areas of the sole consist desirably of transverse grooves, which extend throughout the width of the sole.

In some cases it may be desired to permit of a bending of the boot only in an exactly predetermined direction. In this case the substantially rigid portions of the upper which adjoin the flexible areas may be provided with guiding elements which bridge the flexible areas and consist, e.g., of longitudinal ribs which have cooperating sides, and said guiding elements are adapted to interfit like teeth of combs so that they permit of bending movement only at right angles to their longitudinal direction but not at an oblique angle thereto.

An embodiment of the invention is shown by way of example in the drawing, in which FIG. 1 is a side elevation showing a skiing boot according to the invention and FIG. 2 is a fragmentary longitudinal sectional view showing the toe portion of the skiing boot.

The skiing boot 1 comprises an upper having a top portion 2 and a base portion 3, which is integrally molded with a sole 4, which in turn is formed with a heel 5. The top portion 2 of the upper may have various shapes and may be provided with various fastening means, as may be required, and for this reason is indicated here only by its contour.

The drawing shows the outside of a righthand skiing boot. An inner boot 6 may be provided, which is adaptable to the foot and cushions the same.

The upper of the skiing boot shown on the drawing has a longitudinal slot 7, which is defined by edges 8, 9, which overlap over the slot 7. Tightening buckles 10, 11 serve to close the slot in the upper.

That portion of the skiing boot which is disposed between the instep arch 12 and the rear end portion 13 of the boot, inclusive of the portion which carries the buckle 11 and the keeper cooperating therewith, which is not identified, is substantially stiff. Stiffness of the sole 4 is increased by a stiffening rib 14 extending to the heel 5.

Two zones 17, 18 in which the thickness is reduced are respectively provided between the area which carries the buckle 11 and the forward end 16 of the boot. These zones 17, 18 are supplemented by transverse grooves 19, 20 of suitable depth, which are formed in the sole and extend throughout the width thereof. As a result, the toe box 16 can be bent about the zone 18, 20 relative to the adjacent upper portion which, in turn, can be bent about the zone 17, 19 relative to the stiff rear portion of the boot. Ribs 21 are formed in the zones 17, 18 to prevent a formation of excessively deep folds when the boot is bent.

A horizontal surface 22 supporting the boot is shown in FIG. 1 so that curved portions 23, 24 of the tread face 25 of the sole 4 are more clearly apparent. These curved portions facilitate walking. The curved portion 23 extends from the ball portion to the forward end of the boot. The curved portion 24 of the heel 5 extends to the rear end of the boot.

The bearing surface 26 in the cavity 27 defined by the upper is determined by the last or the mold core. It is apparent from FIG. 2 that his bearing surface is shaped like the bearing surface of a conventional skiing boot so that the inside contour of the boot and the position of the bearing surface 26 relative to the supporting surface 22 for the boot are not changed by the provision of the curved portion 23. The wall thickness of the sole 4 is tapered approximately in the shape of a wedge between its ball portion and its forward end. Soles of uniform thickness have previously been formed adjacent to the toes with bulges in order to reduce the weight. Such bulges may be eliminated in the present boot. The wall thickness of the sole is selected only in dependence on the requirements as to stability and torsional stiffness and a wall thickness of about 5–6 mm is sufficient in practice.

What is claimed is:

1. A skiing boot which comprises an upper end and a sole integrally molded with the upper of synthetic resin material, the upper of the boot having an instep bend, a substantially stiff rear base portion extending from the instep bend to a rear end of the boot, an elongated top portion extending from the rear base portion for engagement with the lower leg of a skier above the ankle thereof, and a forward portion extending from the instep bend to a forward end of the boot, the forward portion being formed with areas of reduced wall thickness extending transversely to the longitudinal direction of the boot and disposed in at least one transversely extending zone between the instep bend and forward end whereby the forward portion is adapted to be bent about said zone.

2. The skiing boot of claim 1, wherein the sole is formed with areas of reduced wall thickness extending transversely of the longitudinal direction of the boot substantially in alignment with the areas of reduced wall thickness in the forward portion.

3. The skiing boot of claim 2, wherein the zone wherein the areas of reduced wall thickness are disposed is annular.

4. The skiing boot of claim 1, comprising a plurality of said zones spaced apart between the instep bend and forward end.

5. The skiing boot of claim 4, further comprising a buckle carried by the upper between adjacent ones of the zones and between a last one of said zones and the instep bend.

6. The skiing boot of claim 5, wherein one of the adjacent zones is disposed frontward of the ball portion and the other adjacent zone is disposed rearward of the ball portion of the boot.

7. The skiing boot of claim 1, wherein the sole has a tread face curved upwardly from the ball portion to the forward end of the boot.

8. The skiing boot of claim 1, wherein the sole tapers in thickness from the ball portion to the forward end of the boot.

* * * * *